US010011411B2

(12) United States Patent
Eberhard

(10) Patent No.: US 10,011,411 B2
(45) Date of Patent: Jul. 3, 2018

(54) PLASTIC POUCH AND PLASTIC BAG, IN PARTICULAR FOR ONLINE DELIVERY TRADE

(71) Applicant: Papier-Mettler KG, Morbach (DE)

(72) Inventor: Patrick Eberhard, Morbach (DE)

(73) Assignee: Papier-Mettler KG, Morbach (DE)

( * ) Notice: Subject to any disclaimer, the term of this patent is extended or adjusted under 35 U.S.C. 154(b) by 0 days.

(21) Appl. No.: 14/997,292

(22) Filed: Jan. 15, 2016

(65) Prior Publication Data

US 2016/0207682 A1 Jul. 21, 2016

(30) Foreign Application Priority Data

Jan. 16, 2015 (DE) ..... 20 2015 000 201 U
Jan. 16, 2015 (EP) ..... 15151504

(51) Int. Cl.
*B65D 75/00* (2006.01)
*B65D 75/26* (2006.01)
(Continued)

(52) U.S. Cl.
CPC ..... *B65D 75/26* (2013.01); *B65D 31/02* (2013.01); *B65D 33/02* (2013.01); *B65D 65/40* (2013.01)

(58) Field of Classification Search
CPC ..... B65D 75/26; B65D 65/40; B65D 31/02; B65D 33/02
(Continued)

(56) References Cited

U.S. PATENT DOCUMENTS 5,340,632 A * 8/1994 Chappuis ..... B29C 49/0047 156/497
6,755,568 B2 * 6/2004 Malone ..... B29C 65/18 206/522
(Continued)

FOREIGN PATENT DOCUMENTS

DE 7142769 U 10/1973
DE 82 29 927.7 U1 12/1982
(Continued)

OTHER PUBLICATIONS

Extended European Search Report dated Jul. 22, 2015, for European Application No. EP 15 15 1504, 2 pages.

*Primary Examiner* — Peter Helvey
(74) *Attorney, Agent, or Firm* — Seed IP Law Group LLP

(57) ABSTRACT

The present disclosure provides a plastic pouch or bag comprising a front wall, a rear wall, an opening and a bottom. The front wall and/or the rear wall have at least three layers, wherein the at least three-layered front wall and/or the at least three-layered rear wall comprise one first layer (inner layer), at least one second layer (intermediate layer) and one third layer (outer layer). The first layer faces the inside of the pouch or bag in relation to the second layer and/or forms the inner side, wherein the at least one second layer is arranged between the first and third layer and comprises or consists of a plastic film, and wherein the third layer faces the outside of the pouch or bag in relation to the second layer and/or forms the outer side. The at least one second layer comprises a plurality of riffled or folded strip-shaped longitudinal areas at a distance from each other, and the at least one second layer is connected to the first and/or third layer by means of welded and/or glued seams, which run transverse to the riffled or folded strip-shaped longitudinal areas.

38 Claims, 3 Drawing Sheets

(51) Int. Cl.
*B65D 65/40* (2006.01)
*B65D 33/02* (2006.01)
*B65D 30/08* (2006.01)

(58) Field of Classification Search
USPC ..... 383/105
See application file for complete search history.

(56) References Cited

U.S. PATENT DOCUMENTS

| | | | | |
|---|---|---|---|---|
| 8,251,216 | B1 | 8/2012 | Liao | |
| 2005/0226542 | A1 | 10/2005 | Kendall et al. | |
| 2008/0159659 | A1* | 7/2008 | Liao | B65D 81/052 383/3 |
| 2008/0197041 | A1* | 8/2008 | Jian | F16F 9/0418 206/522 |
| 2008/0314783 | A1* | 12/2008 | Yoshifusa | B65D 81/052 206/522 |
| 2009/0050509 | A1* | 2/2009 | Liao | B65D 81/052 206/522 |
| 2009/0050510 | A1* | 2/2009 | Kojima | B65D 81/052 206/522 |
| 2010/0072103 | A1* | 3/2010 | Watanabe | B65D 81/03 206/522 |

FOREIGN PATENT DOCUMENTS

| | | | |
|---|---|---|---|
| DE | 42 19 258 | A1 | 10/1993 |
| DE | 43 28 324 | C2 | 9/1999 |
| DE | 10 2009 058 798 | A1 | 6/2011 |
| EP | 0 172 142 | A2 | 2/1986 |
| EP | 0 172 142 | A3 | 2/1986 |
| WO | 2010/024499 | A1 | 3/2010 |

* cited by examiner

PLASTIC POUCH AND PLASTIC BAG, IN PARTICULAR FOR ONLINE DELIVERY TRADE

BACKGROUND

Technical Field of Invention

The present disclosure provides a plastic pouch and a plastic bag, in particular an online delivery pouch and an online delivery bag. The disclosure further provides the use of such a delivery pouch and delivery bag for transporting goods for delivery, in particular goods for delivery for online trading.

Description of the Related Art

Delivery bags are sufficiently known from the prior art.

Standard plastic pouches or bags are here frequently designed with a single layer. However, this has disadvantages with regard to impact protection. Single-layer plastic pouches or bags of this type can also be very easily perforated, so that the contents become contaminated or are even lost.

Frequently, paper pouches with an inner layer consisting of air bubble film are used as delivery pouches. However, these have the disadvantage that due to the air bubble film, the envelopes are already very thick even without the contents. They are also very costly to produce.

A delivery pouch is described in DE 42 19 258 which contains two film layers made of polyethylene facing the inner sides of the front side and rear side respectively. Between these two PE films, air chambers are provided which extend over the entire length of the delivery bag. The individual layers which form the delivery pouch are welded around their circumference in the region of the upper edge. Lengths of paper coated with polyethylene are used as outer layers of the delivery pouch.

In DE 43 28 324 C2, a padded delivery pouch is described the walls of which consist of two paper layers which form a sheath for the padding. These paper layers are connected to each other along their edge. Furthermore, an insert is provided of stamped paper, which forms a padding and which extends continuously from the front side via the bottom which is formed by folding around a fold line through to the rear side of the bag. As is the case with DE 42 19 258, the subject of DE 43 28 324 C2 is a delivery bag made of paper which is equipped with padding.

The air-padded delivery pouch described in DE 71 42 769 is characterized by the fact that the length of an air-bubble film is connected by means of linear weld connections to a length of a carrier material which is coated with weldable plastic material. These linear weld connections can run in any direction and serve solely to reinforce the delivery pouch. The air-bubble film is here formed from a plurality of nap-type closed or sealed air bubbles.

DE 82 29 927 describes a delivery bag made of corrugated cardboard, with which a padding and a reinforcement are also created by means of so-called incisions on the inner side which run parallel to the side edges. These incisions are in direct contact with the inner area and are not covered by a further length of film.

DE 43 43 798 C2 discloses a method for producing an air bubble delivery bag. The delivery bag obtained according to this method is formed from continuous lengths, which are combined and welded together to form air chambers. The interlocking layer system which forms the walls of this delivery bag comprises a so-called fixation layer, preferably made of LD polyethylene, a paper layer and two plastic layers as so-called padding layers.

Finally, DE 10 2009 058 798 describes an inside bag for delivery with two air-bubble film areas which are essentially arranged with parallel surfaces, and with air bubble structures which are enclosed within them. Here, single-piece, tubular air bubble sheaths can be used.

Production of the delivery pouches known from the prior art is still always very costly, and regularly leads to very voluminous products.

There is accordingly a need to overcome the disadvantages of the prior art and in particular to provide plastic pouches or bags which particularly effectively protect the contents from damage and/or contamination through environmental influences. There is accordingly a further need to protect the contents of the delivery pouch from humidity, for example in the form of rain, and to enable good storage of the delivery pouches. And, there is accordingly a need to provide a delivery pouch construction which permits the lowest possible packing volume without having to take into account impairment of the padding. Finally, there is accordingly a need to provide delivery pouches which can be transported and sorted on standard letter sorting systems in post office distribution centers, without being damaged and/or without hindering the operation of these sorting systems.

Accordingly, the present disclosure provides a plastic pouch and a plastic bag, comprising a front wall, a rear wall, an opening and a bottom, as well as optionally opposite side walls, wherein the front wall and/or the rear wall have at least three layers, wherein the at least three-layered front wall and/or the at least three-layered rear wall comprise a first layer (inner layer), at least one second layer (intermediate layer) and one third layer (outer layer), wherein the first layer faces the inside of the pouch or bag in relation to the second layer and/or forms an inner side of the pouch or bag, wherein the at least one second layer is arranged between the first and third layer and comprises or consists of a plastic film, in particular polyolefin film, wherein the third layer faces the outer side of the pouch or bag in relation to the second layer and/or forms an outer side of the pouch or bag, wherein the at least one second layer comprises a plurality of riffled or folded strip-shaped longitudinal areas, in particular strips, which run at a distance from each other, and wherein said at least one second layer is connected by way of welded and/or glued seams, which run transverse to the riffled or folded strip-shaped longitudinal areas (also known as the first welded or glued seams) to the first and/or third layer. The welded or glued seams which run transverse to the riffled or folded strip-shaped longitudinal areas are here designed in such a manner that they cross these riffled or folded strip-shaped longitudinal areas.

BRIEF DESCRIPTION OF THE SEVERAL VIEWS OF THE DRAWINGS

Further features and advantages of the present disclosure are presented in the description below, in which preferred embodiments of the present disclosure are explained as examples with reference to schematic drawings without restricting the present disclosure as a result, in which.

DETAILED DESCRIPTION

Figure 1:
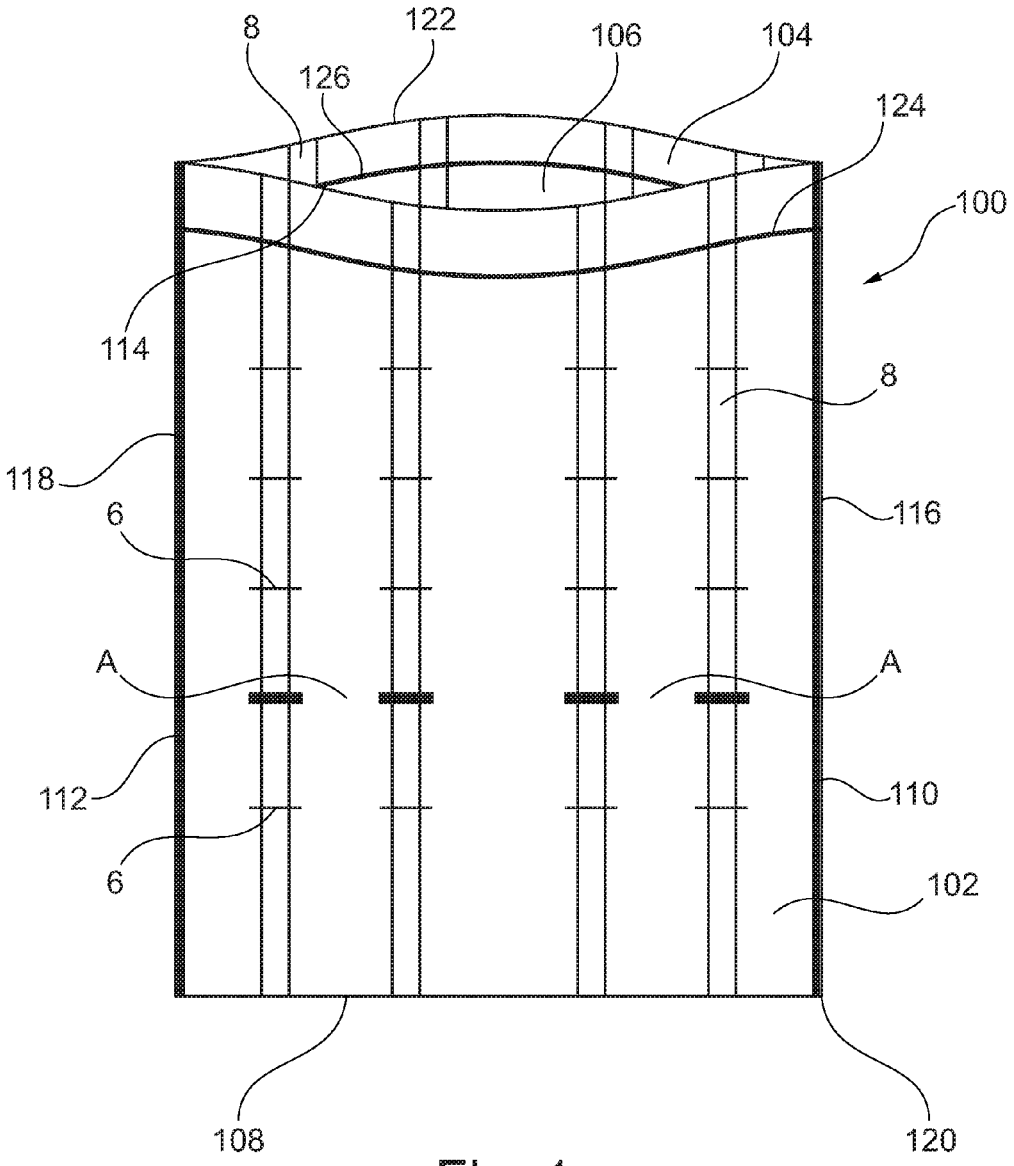
FIG. 1 shows a schematic front view of an embodiment of a pouch according to the present disclosure.

In an advantageous embodiment of the present disclosure, it can here be provided that the first layer (inner layer) of the front and/or rear wall, in particular the first and second layer of the front and/or rear wall, respectively comprise or consist of at least one plastic film, in particular polyolefin film, and/or that the third layer (outer layer) of the front and/or rear wall comprises or consists of at least one plastic film, in particular polyolefin film. In particularly advantageous designs, the polyolefin films of the first, second and/or third layer are polyethylene films.

A plastic pouch or a plastic bag in the sense of the present disclosure is then already provided when the intermediate layer (second layer) containing the riffled or folded strip-shaped longitudinal areas of the front and/or rear wall is or comprises a plastic film. Accordingly, in one design variant, the first layer or inner layer and/or the third layer or outer layer can be produced from a material other than plastic material, such as paper. However, it is particularly advantageous when not only the second layer, but also the first and/or third layer, preferably the first and third layer, of the three-layer composite which forms the front and/or rear wall are formed from plastic films. Accordingly, the plastic pouches or bags according to the present disclosure also comprise such receptacles in which the front wall or the rear wall are formed from the at least three-layered plastic film composite described above, and in which the respective opposite wall is based on a paper or cardboard layer, which can optionally be laminated with a plastic material. Here, those embodiments are particularly suitable with which the at least one second layer and the first layer (inner layer) of the front and/or rear wall are a plastic film, in particular polyolefin film. With this variant, the third layer (outer layer) of the front or rear wall can then be based on a material other than plastic material, such as a paper or cardboard layer or a metal film, optionally mounted on a paper, cardboard or plastic layer. Preferably, the outer layer of the front and/or rear wall is formed from a plastic film, in particular polyolefin film, if the first layer (inner layer) and the at least one second layer (intermediate layer) are based on plastic films. Advantageously, for such first and second, or first, second and third layers, the same plastic material is used, such as polyethylene or polypropylene. In this manner, single-variety containers are achieved, which are particularly easy to recycle.

The riffled or folded strip-shaped longitudinal areas which run at a distance from each other are preferably designed in the form of longitudinal strips. Here, their longitudinal orientation is far more strongly developed than their transverse orientation. In this case, the riffled or folded strip-shaped longitudinal areas which are at a distance from each other can also be regarded or designated as riffled or folded strips. The riffled or folded strip-shaped longitudinal areas preferably do not cross. In a particularly preferred manner, an intermediate section, which is in particular flat, lies between the adjacent riffled or folded strip-shaped longitudinal areas, which separates these adjacent areas.

In one possible design of the plastic pouches or bags according to the present disclosure, it can here be provided that in profile, the riffled strip-shaped longitudinal areas are in particular essentially groove-shaped protrusions, each comprising and opening and a depression, of sections of the second layer. The depression of the protrusion lies opposite the opening of said protrusion, and can also be understood as being the bottom area of the protrusion. Due to the generally flexible nature of plastic films, the riffled strip-shaped longitudinal areas generally do not have a uniform shape for the protrusions over their entire length, or an identical transverse form. The edges which form the opening of the protrusion can also at least at times lie in close proximity to each other, touch each other or even overlap in sections, due to the flexible nature of the plastic layer. As a result, the basic orientation of the protrusion, which forms the riffled strip-shaped longitudinal area, does not as a rule become lost. The profile form of the groove-shaped protrusion corresponds in one design to an essentially U-shaped profile.

The depression of the protrusions of the riffled strip-shaped longitudinal areas preferably faces towards the first layer, and the opening of the riffled strip-shaped longitudinal areas preferably faces towards the third layer. In this manner, pouches or bags according to the present disclosure can be obtained which in a relatively simple manner enable highly effective padding without creating a voluminous addition to the wall. Alternatively, it is also possible to attach the depression of the protrusions of the riffled strip-shaped longitudinal areas facing towards the third layer, and the opening of the riffled strip-shaped longitudinal areas facing towards the first layer.

According to a further design, the folded strip-shaped longitudinal areas are also in profile essentially Z-shaped folds of sections of the second layer. With an essentially Z-shaped fold, as with the protrusion, a deviation from the usually smooth-surface structure of a plastic film is also present. In the area of the Z-shaped fold, there is an increased addition of material and thus also voluminous sections, which when force is applied are at the same time yielding and thus also contribute to a padding effect.

It has furthermore been shown to be advantageous that the front wall and the rear wall have at least three layers, and respectively comprise the first, second and third layer, wherein in particular, the first and second layer and optionally also the third layer of the front or rear wall respectively comprise or consist of at least one plastic film. In this manner, pouches or bags are obtained which due to adequate padding sufficiently protect the stored goods for delivery, in particular without being provided in a voluminous package format.

Those pouches or bags according to the present disclosure have been shown to be particularly advantageous and practical during production with which the riffled or folded strip-shaped longitudinal areas run essentially orthogonally to the welded or glued seams.

Furthermore, those embodiments are particularly advantageous with which the first and/or third layer, in particular the first and third layer, are formed with a smooth surface. Film layers are e.g. smooth-surfaced in the sense of the present disclosure when they are not subjected to a treatment step in which the film has been given a three-dimensional structure, at least in sections. Thus, plastic films such as those which are available commercially wound on rolls are smooth-surfaced films in the sense of the present disclosure. These films, when spread out on a horizontal plane, lie continuously flat on the surface of this plane.

With regard to production and handling, those plastic pouches or bags according to the present disclosure have been shown to be advantageous with which the bottom is formed by a seam or a fold of the first layers of the front wall and rear wall, in particular selected from at least two layers from the first, second and third layer. In a particularly preferred manner, the at least three-layered front wall and the at least three-layered rear wall are essentially formed as a single piece, wherein a fold created by folding is present in the transition from the front wall to the rear wall in the area of the bottom. In a further embodiment, the bottom of the bag or the pouch can also comprise a bottom fold. As a result, a larger bag or pouch volume is achieved. The bottom containing the bottom fold is preferably designed with three layers, and in particular has the same structure as the at least three-layered front wall and/or rear wall. The bottom containing the bottom fold can also be formed from the first layer, as described for the front wall and rear wall. In a particularly preferred manner, the bottom containing the bottom fold can also be formed from the first, second and third layer, as described above for the front wall and rear wall. Here, those plastic pouches or bags are particularly suitable with which the front wall and rear wall and optionally the bottom area containing the bottom fold are part of the same continuous at least three-layered film composite, comprising the first, second and third layers, wherein the separation of the front wall from the rear wall is achieved by way of the at least three-layered film composite.

The transverse-running welded and glued seams can be continuous or discontinuous, wherein the discontinuous design is preferred.

With the plastic pouches and bags according to the present disclosure, the welded seams are preferably thermoplastic welded seams. These welded seams can be designed to be continuous and uninterrupted or discontinuous. Surprisingly, it has been shown that those designs are particularly preferred in which the welded seams are discontinuous.

The transverse-running adhered and welded seams (also referred to as the first welded or glued seams) can be linear as well as strip- or bar-shaped, i.e. they can be wider in form.

In a particularly preferred manner, the at least one second layer is connected by way of the welded and/or glued seams, in particular by way of thermoplastic welded seams, to the first layer (inner layer), in particular when present in the form of a plastic film.

The transverse-running welded or glued seams can in an advantageous embodiment be formed by a row of welded or adhered sections, in particular weld points, which are at a distance from each other. These preferably are essentially at the same distance from each other as the riffled or folded strip-shaped longitudinal areas. Here, it can be provided, for example, that the welded seams are formed by a row of weld points at a distance from each other. Here, the welded seams are preferably essentially at the same distance as the strips.

Particularly satisfactory results with regard to flexibility, stability and padding characteristics can in particular also be achieved with those plastic pouches and bags according to the present disclosure in which the transverse-running adhered or welded seams do not close, or do not fully close, the sections of the first and second layer and/or of the second and third layer between adjacent riffled or folded strip-shaped longitudinal areas along the adhered or welded seams. In other words, the transverse-running welded or glued seams do not close, or do not fully close, the sections of the first and second layer and/or of the second and third layer between adjacent riffled or folded strip-shaped longitudinal areas along these welded or glued seams. Here, the welded or glued seams can also be formed by a row of weld or adhesion points at a distance from each other, which are respectively present in the crossover area of riffled or folded strip-shaped longitudinal areas and the welded or glued seams that run transverse to the riffled or folded strip-shaped longitudinal areas. This can for example be contrived in such a manner that the welded seams are formed by a row of weld points at a distance from each other, wherein the welded seams, in particular each welded seam, preferably comprises one weld point each on each riffled or folded strip-shaped longitudinal area, which crosses the welded seam.

Accordingly, it can be provided that the welded or glued seams are formed by a row of welded or adhered sections, in particular weld points, which are at a distance from each other, which preferably are at essentially the same distance as the riffled or folded strip-shaped longitudinal areas.

The method has been shown to be particularly economic when the adhered or welded seams are essentially allowed to run parallel to each other. It is also preferred when the riffled or folded strip-shaped longitudinal areas run essentially parallel to each other.

Depending on the size of the pouches and bags according to the present disclosure, they can for example comprise at least 5, in particular 10, adhered or welded seams.

The plastic pouches and plastic bags according to the present disclosure can also comprise at least 5, in particular at least 15, strip-shaped longitudinal areas or strips.

The strip-shaped longitudinal areas of the second layer generally have an average extension of at least 1 mm orthogonally to their longitudinal orientation in a state where they are spread flat on one plane, preferably of at least 5 mm and in particular in the region of 1 mm to 2 cm, and particularly preferred, in the region of 0. to 1.5 cm, such as 1 cm. The distance between adjacent strip-shaped longitudinal areas is generally on average at least 1 mm, preferably at least 3 mm, and lies on average in particular in the region of 1 mm to 3 cm, and particularly preferred, in the region of 3 mm to 1.5 cm.

The sections of the second layer which are present between the strip-shaped longitudinal areas, also referred to as intermediate sections, are generally designed to be flat. When the pouch or bag is in a state in which it is laid down on one plane, these sections are preferably essentially parallel with the adjacent flat first and third layers.

The plastic pouches or bags according to the present disclosure can in an advantageous design provide that the number of strip-shaped longitudinal areas or strips is greater than the number of adhered or welded seams.

In a preferred embodiment of the plastic pouches or bags according to the present disclosure, it is provided that the riffled or folded strip-shaped longitudinal areas extend in the direction of the opening to the bottom, in particular from the opening to the bottom. It is also been shown to be advantageous when the riffled or folded strip-shaped areas or strips run essentially parallel to at least one side edge, in particular both side edges, of the front or rear wall. The riffled or folded strip-shaped longitudinal areas are advantageously applied in the second layer in such a manner that they do not cross or touch each other, but that instead, an intermediate space or intermediate section remains between them.

Very practical plastic pouches or bags according to the present disclosure are attained in a particularly simple and reliable manner when either the at least three-layer rear wall or only the outer layer of the at least three-layered rear wall protrudes over the front wall in the area of the opening. This section which protrudes over the front wall in the area of the opening can be folded over and in this manner be used to close the opening. Here, it is particularly preferred that the section of the at least three-layered rear wall which protrudes over the front wall or the section of the outer layer which protrudes over the front wall comprises on the side facing away from the outer side of the plastic pouch or plastic bag an adhesive strip, which in particular extends from the first side edge to the opposite second side edge. As a result, a reliable and easy to handle closure of the plastic pouch according to the present disclosure or the plastic bag according to the present disclosure is guaranteed.

In a further advantageous design of the plastic pouch or bag according to the present disclosure, it can be provided that the first, second and third layers are connected in the direction of the edges of the side walls and/or in the direction of the opening by at least one, in particular continuous, welded or glued seam (also referred to as the second welded or glued seam). Here, those embodiments are particularly suitable in which the first, second and third layer along the side edges or at a distance from the side edges of the front and/or rear wall and/or along the upper edge or at a distance from the upper edge and/or along the bottom or at a distance from the bottom of the front and/or rear wall are connected to each other by way of at least one, in particular continuous, welded or glued seam (also referred to as the second welded or glued seam). While the first welded and glued seams are those welded or glued seams which run transverse to the riffled or folded strip-shaped longitudinal areas, the second welded and glued seams refer to those welded or glued seams with which the first, second and third layer of the front and/or rear side along or at a distance from the opening and along or at a distance from the side edges of the front and/or rear side are connected by way of welding or adhesion.

Good padding characteristics with a simple procedure at the same time can be achieved when the second layer is connected to the third layer solely via the welded and/or glued seam (the second welded or glued seam) along or at a distance from the upper edge of the front and/or rear wall, in particular the front and rear wall, and to the first layer by way of the welded and/or glued seams (second welded or glued seams) along or at a distance from the side edges of the front and/or rear wall, in particular the front and rear wall. With this embodiment, the edge is not also connected to the third layer by way of the transverse-running welded or glued seams.

In a particularly preferred design of the plastic pouch or plastic bag according to the present disclosure, it is provided that the at least one second layer, in particular polyethylene film, is connected to the first layer by way of the discontinuously transverse-running welded seams, comprising or consisting of a plastic film, in particular polyethylene film, that the second layer is connected to the third layer, comprising or consisting of a plastic film, in particular polyethylene film, solely via the, in particular continuous, welded seam (second seam) along or at a distance from the upper edge of the front and rear wall, and to the first layer by way of the, in particular continuous, welded seam (second seam) along or at a distance from the side edges of the front and rear wall, that the front and rear wall are essentially formed as a single piece, wherein in the transition from the front wall to the rear wall in the area of the bottom, a fold or bottom fold created by folding is present, and that the riffled or folded strip-shaped longitudinal areas essentially extend from the opening to the bottom, wherein the, in particular continuous, welded or glued seam crosses the riffled or folded strip-shaped longitudinal areas along or at a distance from the upper edge of the front and rear wall.

Those plastic pouches and plastic bags according to the present disclosure are also suitable with which the, in particular continuous, welded seam or glued seam (second welded or glued seam), in particular the welded seam, which crosses the riffled or folded strip-shaped longitudinal areas which run along the upper edge or which run at a distance from the upper edge, is applied in such a manner that in the crossover area with the riffled or folded strip-shaped longitudinal areas, no welding or adhesion is present, or only an incomplete welding or adhesion is present to the extent that air can continue to pass through these riffled or folded areas into and out of the intermediate space between the first and second layer, and in particular out of and into the intermediate space between the second and third layer. In other words, the welding or adhesion should in these cases be conducted in a controlled manner, so that the riffled or folded strip-shaped longitudinal areas are not fully sealed, while at the same time, a fixed and permanently durable connection is created between the first, second and third layer.

As a result, it is possible to pile the walls of the pouches and bags according to the present disclosure into stacks with a relatively low stack height, thus reducing transport costs. In this manner, ripping or bursting of the film layers during generic use is prevented, such as can occur e.g. with sealed, napped lengths of material. However, those designs are also advantageous in which the welded or glued seams tightly connect the first, second and third layer along the upper edge or at a distance from the lower edge, so that no air can exit or enter through the riffled or folded strip-shaped areas which cross the welded or glued seams. With the welded or glued seams which cross the riffled or folded strip-shaped longitudinal areas which run along the upper edge or which run at a distance from the upper edge, it is ensured that no opening, also no partial opening in sections, is present between the first and the second layer, or between the first and the third layer of the front and rear wall, which the goods for delivery could enter or which could become entangled in the machine parts of sorting systems.

The plastic bag according to the present disclosure can have e.g. at least one carrier loop or at least one carrier hole.

Furthermore, the plastic pouch or bag according to the present disclosure can have a length and a width such that the length is greater than the width, and the opening essentially extends over the entire width.

Preferably, the plastic pouch according to the present disclosure or the plastic bag according to the present disclosure is an online delivery pouch or an online delivery bag.

"Essentially parallel" in the sense of the present disclosure should be understood to mean that the strip-shaped longitudinal areas or the welded or adhered lines deviate from the ideal parallel arrangement by less than 10°. "Orthogonal" in the sense of the present disclosure should also include those arrangements which deviate from the ideal orthogonal arrangement by less than 10°. "At essentially the same distance" in the sense of the present disclosure should also include those embodiments with which the distances do not deviate from each other by more than ten percent.

With the present disclosure comes the surprising finding that delivery pouches and bags can be obtained in a relatively simply manner, without having to take into account impairment to the padding characteristics. Here, it is also of particular advantage that adequate padding characteristics can be obtained with relatively thin-walled systems. Additionally, it is possible to forego the use of cardboard or paper, so that single-variety pouches or bags are obtained from plastic materials, which can be accessed from recycled materials at a low cost. It has also been shown to be advantageous that air-bubble film containing airtight sealed padded naps can be avoided entirely. It has been shown to be of very particular advantage that the pouches and bags according to the present disclosure can also be used as delivery receptacles, which can be transported and sorted on standard letter sorting systems in postal distribution centers, which are commonly only intended for letters, but not for packages. Products such as books or DVDs which are ordered online are usually dispatched in large-volume cardboard or air-bubble packaging. The dispatch and distribution is here usually conducted in package distribution centers, which have suitable transportation and sorting systems. Receptacles of this type are namely not accepted by standard letter sorting systems. There is a risk that these receptacles will destroy machine parts or become entangled in the machine parts of letter sorting systems. By contrast, the pouches and bags according to the present disclosure allow a packaging sheath which provides sufficient reliable protection during transportation and storage for the objects to be transported, while at the same time not requiring a large or bulky volume. The bags and pouches according to the present disclosure provide for the first time transportation receptacles for online trade which can be processed on standard letter sorting systems in postal distribution centers.

FIG. 1 shows the front view of a pouch 100 according to the present disclosure. The pouch is formed by a front wall 102 and a rear wall 104, which are connected to each other along their opposite side edges 110, 112 via welded seams 116, 118 (second welded seams). In the design shown, the pouch bottom 108 is obtained by folding over or folding on top of each other of the sections of a uniform material length forming the rear wall to form a fold 120. With the embodiment shown in FIG. 1, the edges of the upper edge 114, 122 of the front and rear wall 102, 104 run essentially at the same height. Between these, the opening 106 of the pouch 100 is located. The front wall 102 and the rear wall 104 are in the embodiment variant shown each formed from three plastic layers. Details relating to this are explained below with reference to FIG. 2.

FIG. 1 shows riffled strip-shaped longitudinal areas or strips 8, which are located in the intermediate layer, i.e. in the second layer, of the three-layered film composite. These riffled longitudinal areas extend in the embodiment shown from the upper edge 114, 122 through to the fold 120 of the front and rear wall 102, 104. These strip-shaped areas 8 have a longitudinal extension and are essentially arranged parallel to each other. In the embodiment shown, these longitudinal areas 8 also run parallel to the side edges 110 and 112. Furthermore, a row of welded seams 6 (also referred to as first welded seams) at a distance from each other is present in the front and rear wall 102, 104. These extend in the embodiment shown from the first side edge 110 to the opposite side edge 112 and run essentially parallel to each other. These welding lines 6 cross the riffled longitudinal areas 8 and are accordingly also referred to as transverse-running welded seams. These welded seams 6 contribute to the cohesion of the three-layer film composite of the front and rear wall.

A further contribution to the cohesion of this three-layered film composite of the front and rear wall 102, 104 is made by the opposite welded seams 116, 118 on the side edges 110, 112. These welded seams not only connect the front and rear wall to each other, but also respectively the film layers which form the three-layered composite. Furthermore, the welded seams 124, 126 (second welded seams) on or at a short distance from the upper edge progressions 114, 122 of the front and rear wall 102, 104 contribute to a cohesion of the respective three-layered film composites.

Figure 2:
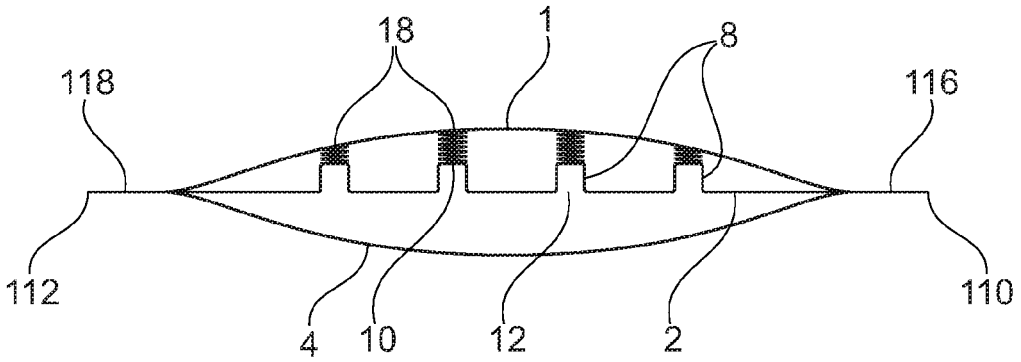
FIG. 2 shows the section of a sectional view of section line A-A of the embodiment according to FIG. 1.

FIG. 2 shows in a schematic view a section view along the section line A-A of the front wall 102 of the pouch 100 according to FIG. 1. FIG. 2 thus shows the structure of the front wall 102 consisting of a first plastic film layer 1, which faces towards the interior of the pouch, and which is thus also referred to as the inner layer, a third film layer 4, which faces the outer side of the pouch or which forms said outer side, and which is thus referred to as the outer layer, and a second plastic film layer 2, which is arranged between the inner layer 1 and the outer layer 4, and which is thus also referred to as the intermediate layer. It has been shown to be particularly advantageous when all three plastic film layers listed above are produced from the same material, in particular polyethylene. In this manner, very durable and firm welded seams or lines and weld points are obtained in a simple and reliable manner. Through the use of essentially identical plastic materials, no de-mixing occurs during thermoplastic welding when the molten film areas harden; to a far greater extent, very thorough mixing is achieved, and thus very good adhesion.

In the embodiment shown in FIG. 2, the riffled areas 8 are shown in profile view in a schematic, idealized form. These longitudinal areas 8 are a bulge or protrusion of the otherwise smooth-surfaced plastic film. In the sense of the present disclosure, these areas are referred to as riffled strip-shaped longitudinal areas. This designation arises from the fact that the bulge or protrusion can be understood as having been created by riffling a smooth-surfaced film materials, similar to the riffling of textile materials when producing items of clothing. In the embodiment shown in FIG. 2, all the riffled longitudinal areas 8 are aligned in essentially the same direction. The riffled longitudinal areas have a depression or floor 10, which faces the inner layer 1, and an opening or outlet 12, which faces the outer layer. Preferably, the intermediate layer 2 of the front and rear wall 102, 104 is equipped throughout with riffled longitudinal strip-shaped areas 8 with the orientation described above.

In a further preferred manner, the intermediate layer 2, as shown in FIG. 2, is connected to the inner layer 1 via thermoplastic weld points or sections 18 in the area of the depression 10 of the riffled areas 8. The weld points or regions 18 which are located at a height form a welding line 6 (see also FIG. 1). Furthermore, it is possible, although not absolutely necessary, to provide further weld points or sections between adjacent riffled areas 8, in order to connect the intermediate layer 2 with the inner layer 1 (not shown). However, this is not absolutely necessary in order to achieve a sufficiently firm composite of the inner and intermediate layer. Naturally, it is also possible to provide weld points or regions between the inner layer 1 and the intermediate layer 2 in those sections which lie between the riffled strip-shaped longitudinal areas 8.

In the embodiment shown, the intermediate layer 2 is not connected to the outer layer 4 via additional welded sections or weld points. In this case, the connection between the outer layer 4 and the intermediate layer 2 is created solely via the welded seams 116 and 118 on the side edges 110 and 112, and via the welded seams 114 and 122 on the upper edge progressions of the front and rear wall 102, 104. In this manner, even though the outer layer 4, unlike the intermediate layer 2, does not have riffled areas in the preferred embodiment shown, but is instead smooth-surfaced, an air cushion is obtained which in addition to the riffled longitudinal areas contributes to a very voluminous appearance of the front and rear wall.

Figure 3:
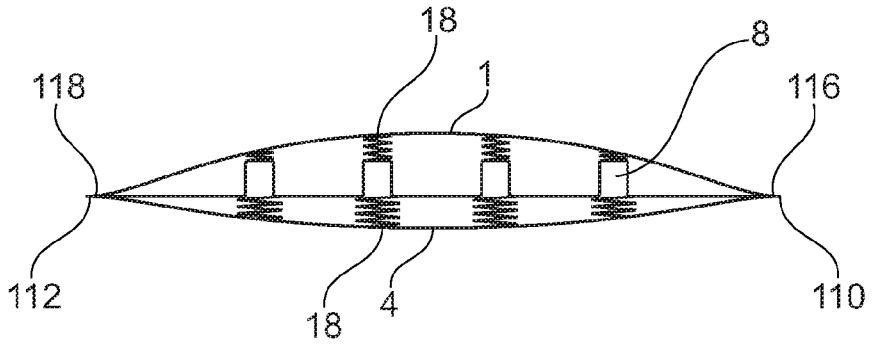
FIG. 3 shows a front view of a further embodiment of a pouch according to the present disclosure.

It has been shown to be advantageous when the riffled areas 8 are formed solely in the direction of the inner layer 1, i.e. the depressions point towards the inner layer, and not in the direction of the outer layer 4 for example. Naturally, it is possible, as is shown in FIG. 3 for example, to obtain a firmer film composite by also applying welded regions or weld points 18 between the outer layer 4 and the intermediate layer 2, e.g. in the region of the riffled longitudinal areas 8.

Figure 4:
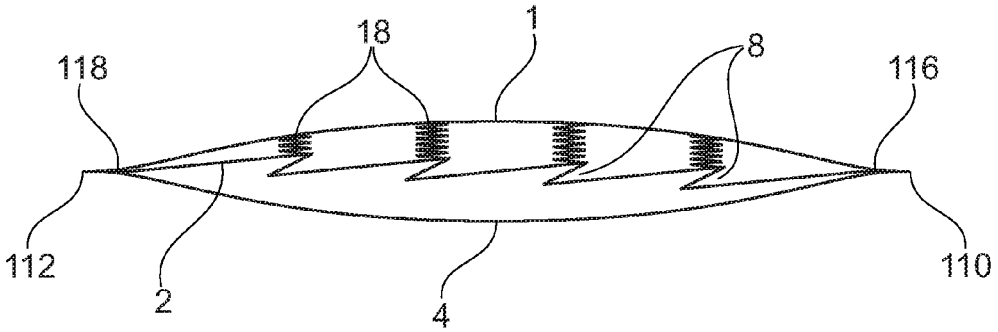
FIG. 4 shows a further schematic section view of a front wall of a pouch according to the present disclosure.

FIG. 4 shows a further advantageous design of a three-layered film composite of the front and rear wall, in which the inner and outer layer 1, 4, are in turn relatively smooth-surfaced. The intermediate layer 2 has folded areas 8, which can be arranged in the same manner as described for the embodiment according to FIG. 2. In these folded areas 8, the otherwise smooth-surfaced structure of the plastic film lengths which form the intermediate layer 2 are interrupted. The folding can, when seen in profile, be described as being essentially Z-shaped. With this embodiment, also, it has been shown to be advantageous to connect the intermediate layer 2 with the inner layer 1 via thermoplastic welded sections or weld points 10. With this embodiment also, a very voluminous front and rear wall is obtained.

Figure 5:
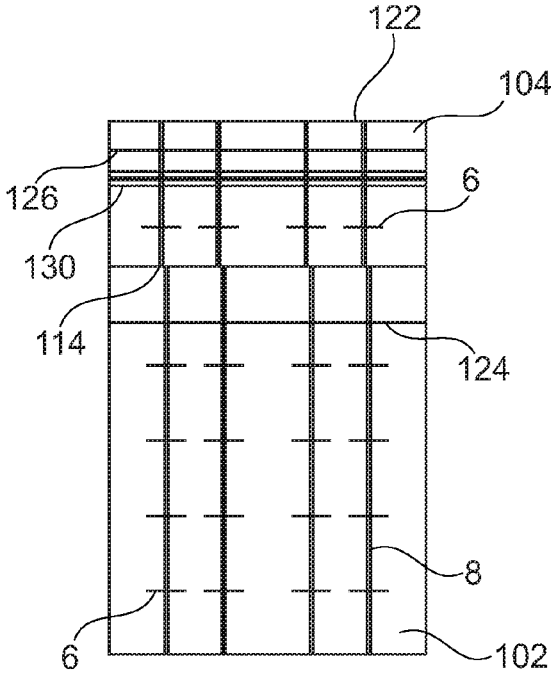
FIG. 5 shows a front view of a further schematic embodiment of a pouch according to the present disclosure.

FIG. 5 shows a modification of pouch according to FIG. 1. The pouch 100 according to FIG. 5 is equipped with a rear wall which is longer than the front wall 102 and which protrudes over the upper edge 114 of the front wall 102. In this manner, a foldover tab 128 is obtained, such as those frequently used in delivery pouches. Advantageously, an adhesive strip 130 extends on the inner layer of the rear wall 104. This is usually equipped with a removable protective layer, which is removed prior to closing by folding over the foldover tab. In this manner, the pouch 100 can be closed in a simple manner in accordance with FIG. 4.

Surprisingly, it has been shown that with very simple means and via a very limited number of process steps, one can achieve a pouch which although it is ultimately formed from very thin and very flexible plastic film layers, is very voluminous and cushioning, and furthermore has a sufficient degree of own stability. It is furthermore of particular advantage that the pouches and bags according to the present disclosure can be obtained in a form which makes it possible to strongly reduce the individual volume without losing the padding characteristics with generic use as a delivery pouch. Here, the bags or pouches according to the present disclosure can even succeed without closed or sealed air cushions. Due to the use of an intermediate layer containing a plurality of riffled or folded strip-shaped longitudinal areas, the welded seams or lines can be designed in such a manner that the through-passage or exchange of air between the sections formed by the areas separated by these welded seams or lines is still possible at all times.

The specific design of the at least three-layered film composite also makes it possible for the welded seams on the upper edges, into which the riffled longitudinal areas preferably open, do not contribute to a sealing of the film composite, but that while guaranteeing sufficient cohesion of the film layers at the same time also guarantee the passage of air. At the same time, due to the welded seams on or at a distance from the upper edges, which cross the folded or riffled longitudinal strip-shaped areas, it can be ensured that the first, second and third layer of the front and rear wall are firmly and permanently connected to each other, so that there is no danger that the delivery material can enter these intermediate spaces or that components of sorting systems can become entangled in these intermediate spaces.

The features of the present disclosure disclosed in the above description, in the claims and in the drawings can be essential both individually and in any combination required for the realization of the present disclosure.

What is claimed is:

1. A plastic pouch or bag comprising a front wall, a rear wall, an opening, and a bottom, wherein the front wall and/or the rear wall have at least three layers, wherein the at least three-layered front wall and/or the at least three-layered rear wall comprise one first layer, at least one second layer, and one third layer, wherein the first layer faces the inside of the pouch or bag in relation to the second layer and/or forms an inner side of the pouch or bag, wherein the at least one second layer is arranged between the first and third layer and comprises or consists of a plastic film, wherein the third layer faces the outside of the pouch or bag in relation to the second layer and/or forms an outer side of the pouch or bag, wherein the at least one second layer comprises a plurality of folded strip-shaped longitudinal areas at a distance from each other, wherein the folded strip-shaped longitudinal areas are in profile essentially Z-shaped folds of sections of the at least one second layer, and wherein the at least one second layer is connected to the first and/or third layer by way of welded and/or glued seams that run transverse to the folded strip-shaped longitudinal areas.

2. The plastic pouch or bag according to claim 1, wherein the first layer of the front and/or rear wall or the first and second layer of the front and/or rear wall, respectively comprise or consist of at least one plastic film and/or the third layer of the front and/or rear wall comprises or consists of at least one plastic film.

3. The plastic pouch or bag according to claim 1, wherein the front wall and the rear wall have at least three layers, and respectively comprise the first, second, and third layer.

4. The plastic pouch or bag according to claim 1, wherein the bottom is formed by a seam or a fold of the first layers of the front wall and the rear wall or by at least two layers selected from the first, second, and third layer, or that the at least three-layered front wall and the at least three-layered rear wall are essentially formed as a single piece, wherein in the transfer from the front wall to the rear wall a fold is present which has been created by folding in the area of the bottom, and/or that the bottom comprises a bottom fold.

5. The plastic pouch or bag according to claim 1, wherein the at least one second layer is connected to the first layer by means of transverse-running welded and/or glued seams and/or the at least one second layer is not connected to the third layer by means of the transverse-running welded and/or glued seams.

6. The plastic pouch or bag according to claim 1, wherein the transverse-running welded or glued seams are formed discontinuously, and/or the transverse-running welded or glued seams are formed by a row of welded or glued sections, which are at a distance from each other.

7. The plastic pouch or bag according to claim 1, wherein the transverse-running glued seams or welded seams do not close, or do not fully close, the sections of the first and second layer and/or of the second and third layer between adjacent riffled or folded strip-shaped longitudinal areas along the glued seams or welded seams, and/or that the transverse-running welded or glued seams are formed by a row of weld or adhesion points at a distance from each other, which are respectively present in the crossover area of riffled or folded strip-shaped longitudinal areas and the welded or glued seams that run transverse to the riffled or folded strip-shaped longitudinal areas.

8. The plastic pouch or bag according to claim 1, wherein the transverse-running glued seams or welded seams run essentially parallel to each other and/or the folded strip-shaped longitudinal areas run essentially parallel to each other.

9. The plastic pouch or bag according to claim 1, wherein said pouch or bag comprises at least five folded strip-shaped longitudinal areas and/or that said pouch or bag comprises at least five transverse-running glued seams or welded seams.

10. The plastic pouch or bag according to claim 1, wherein the folded strip-shaped longitudinal areas extend in the direction from the opening to the bottom and/or the folded strip-shaped longitudinal areas run essentially parallel to at least one side edge or to both side edges of the front and/or rear wall.

11. The plastic pouch or bag according to claim 1, wherein the at least three-layered rear wall or only the third layer of the at least three-layered rear wall protrudes over the front wall in the area of the opening.

12. The plastic pouch or bag according to claim 11, wherein the section of the at least three-layered rear wall which protrudes over the front wall or the section of the third layer which protrudes over the front wall comprises an adhesive strip on the side facing away from the outer side of the plastic pouch or plastic bag.

13. The plastic pouch or bag according to claim 1, wherein the first, second, and third layer are connected to each other along the side edges or at a distance from the side edges of the front and/or rear wall and/or along the upper edge or at a distance from the upper edge and/or along the bottom or at a distance from the bottom of the front and/or rear wall by way of at least one welded or glued seam.

14. The plastic pouch or bag according to claim 1, wherein the second layer is connected to the third layer solely via a welded and/or glued seam along or at a distance from the upper edge of the front or the rear wall or the front and the rear wall, and to the first layer by way of the welded and/or glued seams along or at a distance from the side edges of the front or the rear wall or the front and the rear wall.

15. The plastic pouch or bag according to claim 14, wherein the at least one second layer is connected to the first layer, comprising or consisting of a plastic film, by way of discontinuously transverse-running welded or glued seams, wherein the at least one second layer is connected to the third layer, comprising or consisting of a plastic film, solely via the welded or glued seam along or at a distance from the upper edge of the front and rear wall, and to the first layer by way of the welded or glued seams along or at a distance from the side edges of the front and rear wall, wherein the front and rear wall are essentially formed as a single piece, wherein in the transition from the front wall to the rear wall in the area of the bottom, a fold or bottom fold created by folding is present, and the folded strip-shaped longitudinal areas essentially extend from the opening to the bottom, and wherein the welded or glued seam crosses the folded strip-shaped longitudinal areas along or at a distance from the upper edge of the front and rear wall.

16. The plastic pouch or bag according to claim 1, wherein the welded seams are thermoplastic welded seams.

17. The plastic pouch or bag according to claim 1, wherein the first or the third layer or the first and the third layer are formed with a smooth surface.

18. The plastic bag according to claim 1, wherein said bag comprises at least one carrier loop or at least one carrier hole.

19. The plastic pouch or bag according to claim 1, wherein said pouch or bag is an online delivery pouch or an online delivery bag.

20. The use of the plastic pouch or plastic bag according to claim 1 for transporting goods for delivery.

21. The plastic pouch or bag according to claim 1, wherein the welded and/or glued seams run orthogonally to the folded strip-shaped longitudinal areas.

22. The plastic pouch or bag according to claim 1 further comprising opposite side walls.

23. The plastic pouch or bag according to claim 3, wherein the first layer, the second layer, and the third layer of the front or the rear wall respectively comprise or consist of at least one plastic film.

24. The plastic pouch or bag according to claim 1, wherein the plastic film is a polyolefin film.

25. The plastic pouch or bag according to claim 1, wherein in profile the riffled strip-shaped longitudinal areas are essentially groove-shaped protrusions.

26. The plastic pouch or bag according to claim 6, wherein the transverse-running welded or glued seams are formed by a row of weld points.

27. The plastic pouch or bag according to claim 10, wherein the folded strip-shaped longitudinal areas extend from the opening to the bottom.

28. The plastic pouch or bag according to claim 12, wherein the adhesive strip extends from the first side edge to the opposite second side edge.

29. The plastic pouch or bag according to claim 13, wherein the welded or glued seam is a continuous welded or glued seam.

30. The plastic pouch or bag according to claim 15, wherein the welded or glued seam crosses the riffled or folded strip-shaped longitudinal areas along or at a distance from the upper edge of the front and rear wall without fully closing these areas against penetration by air.

31. The use according to claim 20, wherein the transporting goods for delivery are goods for delivery for online trade.

32. The plastic pouch or bag according to claim 6, wherein the transverse-running welded or glued seams are formed by a row of welded or glued sections at essentially the same distance from each other as the riffled or folded strip-shaped longitudinal areas.

33. The plastic pouch or bag according to claim 2, wherein the plastic film is a polyolefin film.

34. The plastic pouch or bag according to claim 15, wherein the plastic film is a polyolefin film.

35. The plastic pouch or bag according to claim 23, wherein the plastic film is a polyolefin film.

36. The plastic pouch or bag according to claim 15, wherein the welded or glued seam is a continuous welded or glued seam.

37. A plastic pouch or bag comprising a front wall, a rear wall, an opening, and a bottom, wherein the front wall and/or the rear wall have at least three layers, wherein the at least three-layered front wall and/or the at least three-layered rear wall comprise one first layer, at least one second layer, and one third layer, wherein the first layer faces the inside of the pouch or bag in relation to the second layer and/or forms an inner side of the pouch or bag, wherein the at least one second layer is arranged between the first and third layer and comprises or consists of a plastic film, wherein the third layer faces the outside of the pouch or bag in relation to the second layer and/or forms an outer side of the pouch or bag, wherein the at least one second layer comprises a plurality of riffled strip-shaped longitudinal areas at a distance from each other, wherein the riffled strip-shaped longitudinal areas are protrusions created by riffling a smooth-surfaced film material, the riffled strip-shaped longitudinal areas comprising an opening and a depression of sections of the second layer and thermoplastic weld sections in the riffled areas connecting the second layer to the first and/or third layer, and wherein the at least one second layer is connected to the first and/or third layer by way of welded and/or glued seams that run transverse to the riffled strip-shaped longitudinal areas.

38. A plastic pouch or bag comprising a front wall, a rear wall, an opening, and a bottom, wherein the front wall and/or the rear wall have three layers, wherein the three-layered front wall and/or the three-layered rear wall consist of one first layer, one second layer, and one third layer, wherein the first layer faces the inside of the pouch or bag in relation to the second layer and/or forms an inner side of the pouch or bag, wherein the second layer is arranged between the first and third layer and comprises or consists of a plastic film, wherein the third layer faces the outside of the pouch or bag in relation to the second layer and/or forms an outer side of the pouch or bag, wherein the second layer comprises a plurality of riffled or folded strip-shaped longitudinal areas at a distance from each other, wherein when the second layer comprises folded strip-shaped longitudinal areas, the folded strip-shaped longitudinal areas are essentially Z-shaped folds of sections of the second layer, wherein when the second layer comprises riffled strip-shaped longitudinal areas, the riffled strip-shaped longitudinal areas are protrusions and comprise an opening and a depression of sections of the second layer, and wherein the second layer is connected to the first and/or third layer by way of welded and/or glued seams that run transverse to the riffled or folded strip-shaped longitudinal areas.

* * * * *